United States Patent [19]

Casasent et al.

[11] Patent Number: 4,833,637

[45] Date of Patent: May 23, 1989

[54] ACOUSTO-OPTIC MULTI-CHANNEL SPACE INTEGRATING CORRELATOR

[75] Inventors: David Casasent, Pittsburgh; James Lambert, Shaler Township, Allegheny County, both of Pa.

[73] Assignee: Teledyne Industries, Inc., Newbury Park, Calif.

[21] Appl. No.: 898,952

[22] Filed: Aug. 21, 1986

[51] Int. Cl.[4] ..... G06G 9/00

[52] U.S. Cl. ..... 364/822; 364/819; 364/821; 350/358

[58] Field of Search ..... 364/822, 604; 350/358, 350/96.11, 96.12, 96.13, 162.12, 162.13

[56] References Cited

U.S. PATENT DOCUMENTS

| | | | |
|---|---|---|---|
| 4,110,016 | 8/1978 | Berg et al. | 350/358 |
| 4,326,778 | 4/1982 | Berg et al. | 350/358 |
| 4,421,388 | 12/1983 | Berg et al. | 350/358 |
| 4,440,472 | 4/1984 | Cohen | 304/822 X |
| 4,468,084 | 8/1984 | Hutcheson et al. | 364/822 X |
| 4,468,093 | 8/1984 | Brown | 364/822 X |
| 4,641,273 | 2/1987 | Casasent | 364/822 |

OTHER PUBLICATIONS

D. Casasent, Frequency-Multiplexed Acousto-Optic Architecture and Applications, Applied Optics, vol. 24, pp. 856-858 (Mar. 1985).

Sprague & Kolioparlos, Time Integrating Acousto-Optic Correlator, Applied Optics, vol. 15, pp. 89-92 (1976).

D. Cosasent, General Time, Space and Frequency Multiplexed Acoustic Correlator, Applied Optics, vol. 24, pp. 2884-2888 (Sep. 15, 1985).

*Primary Examiner*—Joseph Ruggiero
*Assistant Examiner*—Charles B. Meyer
*Attorney, Agent, or Firm*—Blakely, Sokoloff, Taylor & Zafman

[57] ABSTRACT

Acousto-optic multi-channel space integrating correlators and methods of using the same are disclosed. The correlators consist of a single channel acousto-optic cell illuminated by a light source, with the light from the cell imaged onto a second acousto-optic cell, typically a multi-channel cell, with the light between the two cells being single sideband filtered so as to pass only the desired components. The light from each channel of the second acousto-optic cell is directed to a respective light detector, or utilizing a segmented lens system, is split so that different portions of the light from each channel are directed to a different respective light detector. The acousto-optic cells and the light source are oriented so that the light is incident upon the first acousto-optic cell at the Bragg angle, the DC and a first order component of light from the first acousto-optic cell is incident upon the second acousto-optic cell at the Bragg angle, and the DC component and the first order diffraction component as again diffracted by the second acousto-optic cell is directed to the respective light detector. The result provides for a direct complex correlation between an input signal for the first acousto-optic cell and each of the references applied to each channel of the second acousto-optic cell, useful in synchronization, demodulation and other applications. Various applications of the acousto-optic multi-channel space integrating correlators and methods of preprocessing frequency hopped signals to reduce processor bandwidth requirements are disclosed.

8 Claims, 2 Drawing Sheets

ACOUSTO-OPTIC MULTI-CHANNEL SPACE INTEGRATING CORRELATOR

BACKGROUND OF THE INVENTION

1. Field of the Invention

The present invention relates to the field of acousto-optic correlators.

2. Prior Art

The basic space integrating (SI) optical acousto-optic correlator architecture and concept is well understood. [R. M. Montgomery, "Acousto-optical Signal Processing System", U.S. Pat. No. 3,634,749 (January 1982)] This basic system is limited in the signal duration and range delay that can be processed. The concept of using repeated or cyclic active reference signals in this architecture is likewise well known [D. Casasent, "Frequency-Multiplexed Acousto-Optic Architectures and Applications", Applied Optics, Vol. 24, pp 856–858 (March 1985)]. This cyclic reference signal technique is attractive because it allows an infinite range delay search (essential for synchronization applications), but it significantly limits the maximum signal duration that can be handled to $T_A/2$ (where $T_A$ is the aperture time of the system, i.e. the aperture time of the AO cells used). Prior techniques advanced to overcome these problems have used the well-known time-integrating (TI) AO correlator architecture [R. A. Sprague and C. L. Koliopoulos, "Time-Integrating Acousto-Optic Correlator", Applied Optics, Vol. 15, pp 89–92 (1976)] with single and multi-channel AO cells, multiple input point modulators and frequency-multiplexing [D. Casasent, supra; D. Casasent, "General Time, Space and Frequency-Multiplexed Acoustic Correlator", Applied Optics, Vol. 24, pp 2884–2888 (15 Sept. 1985)]. These architectures require the detection of separate portions of the full large duration signal correlation and the subsequent proper delay and summation of these "mini-correlations". To allow this, complex correlations are necessary. No one has yet detailed how to achieve these complex correlations on acousto-optic processors. In any time integrating (TI) architecture, an excessive number of detectors is required to achieve this (with no processing gain and noise performance loss). The present invention method described herein can be used to accomplish this in a TI system, though such a system is not detailed further herein because the output detector requirements (the number of detectors) is excessive. Thus the present disclosure is directed only to an SI AO correlator. In correlations of coded signals with phase modulation, one must be able to achieve either coherent or noncoherent detection. This issue has not been noted in prior acousto-optic detection correlators. The present invention enables one to achieve both coherent and noncoherent detection.

BRIEF SUMMARY OF THE INVENTION

Acousto-optic multi-channel space integrating correlators and methods of using the same as disclosed. The correlators consist of a single channel acousto-optic cell illuminated by a light source, with the light from the cell imaged onto a second acoutso-optic cell, typically a multi-channel cell, with the light between the two cells being single sideband filtered so as to pass only the desired components. The light from each channel of the second acousto-optic cell is directed to a respective light detector, or utilizing a segmented lens system, is split so that different portions of the light from each channel are directed to a different respective light detector. The acousto-optic cells and the light source are oriented so that the light is incident upon the first acousto-optic cell at the Bragg angle, the DC and a first order component of light from the first acousto-optic cell is incident upon the second acousto-optic cell at the Bragg angle, and the DC component and the first order diffraction component as again diffracted by the second acousto-optic cell is directed to the respective light detector. The result provides for a direct complex correlation between an input signal for the first acousto-optic cell and each of the references applied to each channel of the second acousto-optic cell, useful in synchronization demodulation and other applications. Various applications of the acousto-optic multi-channel space integrating correlators and methods of preprocessing frequency hopped signals to reduce processor bandwidth requirements are disclosed.

DETAILED DESCRIPTION OF THE INVENTION

Advanced herein is a new SI AO correlator architecture together with specific attention to its ability to produce complex-correlations and to add properly delayed complex mini-correlation outputs to achieve correlations for longer duration and larger time bandwidth product (TBWP) signals with no processing gain (PG) loss and no noise performance loss. This allows the processing architecture to handle signals of longer duration with an infinite range delay search. The details of this feature for a general signal synchronization application are given. The basic architecture in Section 2 uses a new split-lens output system, with methods of employing this architecture (and conventional multiplexing signal techniques (D. Casasent, "Frequency-Multiplexed Acousto-Optic Architectures and Applications", Applied Optics, Vol 24, pp 856–858 (March 1985) and D. Casasent, "General Time, Space and Frequency-Multiplexed Acoustic Correlator", Applied Optics, Vol. 24, pp 2884–2888 (15 Sept. 1985) to allow this same architecture to achieve standard message demodulation being given. Also disclosed are preprocessing techniques for frequency hopped (FH) signals to decrease processor bandwidth requirements. A novel property of the processor architecture is its ability to perform frequency selectivity. Finally detailed is the use of the architecture and the FH preprocessing techniques for the synchronization and demodulation of FH encoded general signals. The use of the processor employs this new frequency selectivity feature. The system also allows the use of both coherent and noncoherent detection. Thus, the architecture of the invention has many unique properties.

In the descriptions to follow, different sections are given different headings to better organize the disclosure and for more ready cross reference to different portions thereof.

2. Multi-Channel SI Correlator Architecture

Figure 1:
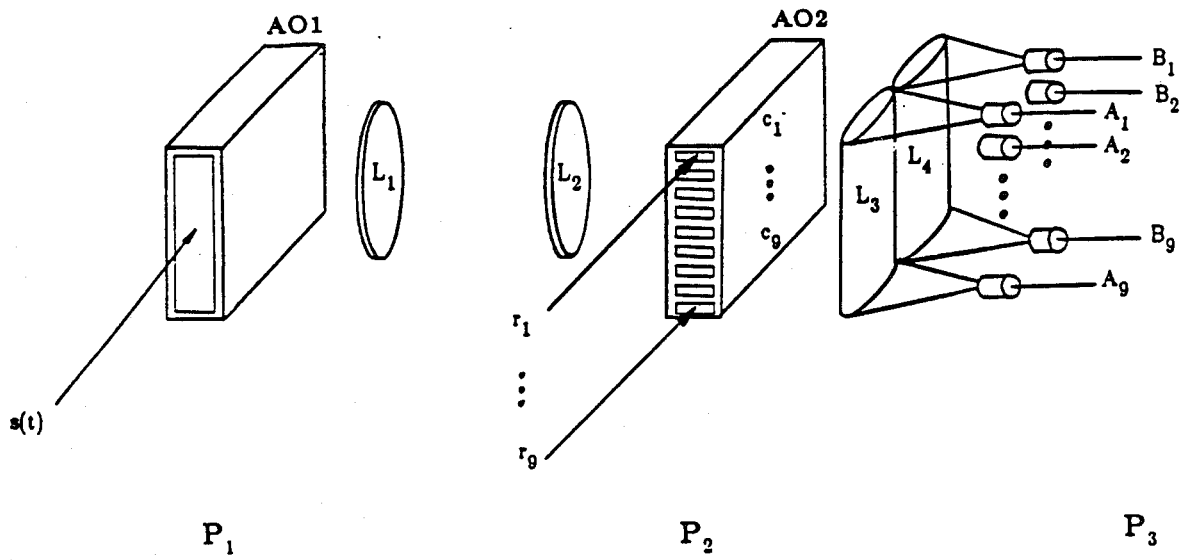
FIG. 1 is a schematic diagram of the basic multifunctional multi-channel space-integrating acousto-optic processor architecture of the present invention.

The basic architecture is shown in FIG. 1. The system consists of a single-channel AO cell (AO1) at $P_1$ imaged by lenses $L_1$ and $L_2$ onto a second AO cell (AO2) at $P_2$. Single sideband (SSB) filtering can be performed at the intermediate plane between $L_1$ and $L_2$, as is subsequently discussed. AO2 is a multi-channel AO cell, and the imaging system ($L_1$ and $L_2$) is designed to image $P_1$ horizontally onto $P_2$ and to expand it vertically such that the same filtered $P_1$ pattern illuminates the different vertical channels of AO2. It is assumed that AO2 has N signal channels. The output lens system ($L_3$ and $L_4$) integrates the light distribution leaving $P_2$ spatially onto detectors at $P_3$. On each of the N output channels, two detectors ($A_n$ and $B_n$ for channel n) are placed, with one detector pair corresponding to each of the N channels of AO2 and with the two detectors per channel positioned to collect the spatially integrated output from $L_3$ and $L_4$ respectively. Lenses $L_3$ and $L_4$ are split lenses that spatially integrate different portions of the light leaving $P_2$.

Considering the operation of the system of FIG. 1, when both $A_n$ and $B_n$ detector outputs on each channel n are summed, each channel of FIG. 1 is a conventional SI AO correlator, and the full system is an N-channel SI correlator. The basic SI correlator using AO cells of aperture time $T_A$ and time bandwidth product $TBWP_A$ with active references (cyclically repeated (D. Casasent, "Frequency-Multiplexed Acousto-Optic Architectures and Applications", Applied Optics, Vol 24, pp 856–858 (March 1985) and D. Casasent, "General Time, Space and Frequency-Multiplexed Acoustic Correlator", Applied Optics, Vol. 24, pp 2884–2888 (15 Sept. 1985))) can handle an infinite range delay search if the signal duration ($T_S$) satisfies $$T_S \leqq T_A/2. \tag{1}$$

If each channel of FIG. 1 satisfies (1), then one can conceptually combine the N output correlation channel data and thus achieve an infinite range delay search for signals of longer duration $$T_S \leqq NT_A/2. \tag{2}$$

From (1) and (2), it can be seen that the advantage of an N-channel processor is an increase (by a factor of N) in the signal duration and TBWP that one can process with an infinite range delay search. Details of the mini-correlation summation required in general and its use for specific synchronization applications are described later under the headings "Standard Waveform Synchronization" and "Frequency Hopped Signal Processing".

If we consider the operation of the system of FIG. 1 with all $A_n$ and $B_n$ detector outputs separately detected and processed, then the system is a modified SI correlator with 2N channels. This version of the FIG. 1 architecture is appropriate for demodulation applications (when multiple references must be searched and when the synchronization time of occurrence of the input signal is known). To achieve this 2N channel parallel correlation of the received signal and 2N reference patterns, proper time-multiplexing of the reference signal inputs to the AO2 chanels is needed, as discussed later for specific headings under the headings "General Signal Demodulation Processing" and "Frequency Hopped Signal Processing".

A fundamental issue associated with the use of this architecture is the fact that each output channel must be a complex correlation (otherwise combining separate channel outputs will result in significant processing gain loss). The topic of complex correlations is addressed separately under the heading "Complex Correlations". All AO cells are assumed to operate in amplitude mode. We assume Bragg mode operation for light efficiency (i.e. only one first-order diffracted wave), although this is not fundamental to the analysis.

The following basic issues are necessary to establish notation and specific issues vital to the system use. The most general input AO signal is described by the real function $$\begin{aligned} s(t) &= a(t)\cos[\omega_c t + \phi(t)] && (3a)\\ &= x_s(t)\cos\omega_c t + y_s(t)\sin\omega_c t && (3b)\\ &= Re[\{x_s(t) - jy_s(t)\}\exp(j\omega_c t)] && (3c)\\ &= Re[z_s(t)\exp(+j\omega_c t)] && (3d) \end{aligned}$$

where a(t) and $\phi$(t) describe amplitude and phase modulation, $\omega_c$ is the angular carrier frequency, and Re denotes the real part. Eq. (3b) follows from trigonometric identities, where $$x_s(t)=a(t)\cos\phi(t),\ y_s(t)=a(t)\sin\phi(t). \tag{4}$$

These $x_s(t)$ and $y_s(t)$ signals in (3) and (4) contain the information portion $z_s(t)$ of the signal, which we write as $$z_s(t)=x_s(t)-jy_s(t). \tag{5}$$

$x_s(t)$ and $y_s(t)$ can be obtained from the received signal in (3a) by mixing s(t) with cos $\omega_c$t and sin $\omega_c$t and low-pass filtering. The signal in (3a) can be viewed as the received signal. However, generally the $x_s(t)$ and $y_s(t)$ terms in (4) are extracted from the received signal and placed on quadrature carriers as in (3b) with $\omega_c$ equal to the center frequency of the AO cell (the intermediate heterodyne frequency). These x(t) and y(t) terms are referred to as I (in-phase) and Q (quadrature-phase) signals. The results are intended to be most general and to apply to the many types of quadrature modulation presently used to reduce the bandwidth (BW) of transmitters or processors.

For a general input electrical signal f(t) cos ($\omega_c$t), the amplitude transmittance of an amplitude mode AO cell (in Raman Nath, RN, mode) is $$t_{RN}(x,t)=1+j\alpha f(t-x')\cos[\omega_c(t-x')], \tag{6}$$

where $\alpha$ is a constant that depends on the AO cell, $x'=x/v_s$ and $v_s$ is the velocity of sound in the AO cell. In general, J$\alpha$ is considered as one complex constant. Because an optical system automatically separates (by diffraction) the exponential components of the cosine term, it is appropriate to view a real signal s(t) as $$s(t)=0.5\tilde{s}(t)+0.5\tilde{s}^*(t) \tag{7}$$

where ( )* denotes complex conjugate and $$\tilde{s}(t)=[x_s(t)-jy_s(t)]\exp(+j\omega_c t) \quad (8a)$$

$$\tilde{s}^*(t)=[x_s(t)+jy_s(t)]\exp(-j\omega_c t). \quad (8b)$$

These signals $\tilde{s}$ and $\tilde{s}^*$ are analytic and thus have one sided spectra. The signal $\tilde{s}$ is referred to as the analytic signal and $\tilde{s}^*$ as the anti-analytic signal. The input laser light will be described by $$u_0(t)=a_0\exp(-j\omega_L t). \quad (9)$$

Use of (7) and (8) yields $$\begin{aligned} t_{RN}(x,t) &= 1+(j\alpha/2)s^*(t-x')+(j\alpha/2)s(t-x'), && (10a)\\ &= 1+(j\alpha/2)z_s^*(t-x')\exp(-j\omega_c t)\exp(+j\omega_c x')+ \\ &\quad (j\alpha/2)z_s(t-x')\exp(+j\omega_c t)\exp(-j\omega_c x'). && (10b)\end{aligned}$$

From (10), it can be seen that $\tilde{s}^*$ and $\tilde{s}$ are the +1 and −1 orders respectively (traveling up and down respectively) and that these contain positive and negative spatial frequencies respectively (i.e. their spectra are one-sided and thus analytic as stated). If the AO cell is operated in Bragg mode, only the DC and one first order term exists. If the AO cell is rotated at $+\theta_B(-\theta_B)$ about the y axis (where $\theta_B$ is the Bragg angle), then the +1 (−1 first order wave exists corresponding to an upward (downward) traveling wave and positive (negative) frequencies. For RN cells, SSB filtering achieves the same result.

Another fundamental issue associated with the system of FIG. 1 and a new property of this system is the manner in which the AO cells are oriented, noted here and detailed later under the heading "Complex Correlations". Bragg amplitude mode cells are assumed, though similar results occur for RN cells with proper SSB filtering. The first cell AO1 is oriented at $+\theta_B$ (the Bragg angle), with the transducer end of AO1 closer to the input light and with the input light parallel to the z axis. The dc and +1 order terms leaving AO1 are both incident on $P_2$ at different angles. The dc term enters $P_2$ parallel to the z axis and the +1 order term leaves $P_1$ at an angle $+2\theta_B$ but enters $P_2$ at an angle $-2\theta_B$ (due to the inversion performed by $L_1$ and $L_2$). The second cell AO2 is oriented at $-\theta_B$ (its transducer end further from the input light) and thus the +1 order beam from AO1 is incident on AO2 at the Bragg angle (so is the DC wave from AO1). Consider the DC wave from AO1 that passes straight through AO2 and the +1 wave from AO1 doubly diffracted a second time by AO2. In Section 3, it is shown that these waves are incident colinearly on the detectors at $P_3$. Thus, by combining (coherently) these two output waves, one can obtain the desired complex correlation output (as detailed in Section 3).

The final major issue of present concern is that should the signals into AO1 and AO2 be at different frequencies, then the two output waves (the dc and doubly-diffracted waves) will not be incident colinearly on the detector for channel n. This is detailed in Section 3. As a result, signals present in AO1 and AO2 at different frequencies will not land on an output detector and thus are not of concern. This frequency selectivity is a new feature of this SI processor, not previously suggested or used. In the discussion in Section 7, this automatic frequency filtering property of the architecture of FIG. 1 will be used in processing frequency-multiplexed data.

3. Complex Correlations

The conventional correlation of two real signals $S_1$ and $S_2$, defined by $$R_{12}=s_1 \circledast s_2=\int s_1(x)s_2(x-\tau)dx \quad (11)$$

is distinguished from the complex-correlation of the analytic signals $$R_{12c}=\tilde{s}_1 \circledast \tilde{s}_2^*=\int \tilde{s}_2(x)\tilde{s}_2^*(x-\tau)dx. \quad (12)$$

In (12), the signals are denoted as complex using (I and Q or similar complex signal representations), whereas in (11) we consider real signals. For two analytic signals $\tilde{s}_1$ and $\tilde{s}_2$, their complex correlation in (12) is $R_{12c}=z_1 \circledast z_2^*$ and has real and imaginary parts given by $$Re\{R_{12c}\}=x_1 \circledast x_2+y_1 \circledast y_2 \quad (13a)$$

$$Im\{R_{12c}\}=x_1 \circledast y_2-y_1 \circledast x_2. \quad (13b)$$

Generally (13a) is desired.

Inherent in the proposed use of the architecture of FIG. 1 is the sum of separate correlation outputs. To achieve this with no processing gain (PG) loss, the real parts of the complex correlations in (13a) must be added. In terms of the x(t) and y(t) signal representations in (3), (4) and (5), the real signal satisfies $$s(t)=Re[z_s(t)\exp(+j\omega_c t)]=x_s(t)\cos\omega_c t+y_s(t)\sin\omega_c t. \quad (14)$$

Considered below is the producing and correlating the complex analytic signals described by (8) using the quadrature (I and Q) data modulation representation in (3b) and (4).

Attention to achieving the complex correlation in (12) and (13) has not been fully and completely addressed for optical processors, and thus detail on how to achieve this on the architecture of FIG. 1 is now given. The real received signal denoted by s(t) as in (3a) or (14), is applied to AO1 of FIG. 1. A real reference signal r(t) described similar to (3a) or (14) is fed to AO2 of FIG. 1. Only considered is a one-channel version of FIG. 1 and a single output integrating lens between $P_2$ and $P_3$ for simplicity. The AO1 input signal denoted by (14) results in a transmittance of AO1 (assuming amplitude mode modulation) given by (10b).

Considering only the dc and +1 order waves, the light leaving $P_1$ is $$\begin{aligned} u_1'(x,t) &= u_0(t)u_1(x,t) && (15)\\ &= a_0e^{-j\omega Lt}+(a_0 j\alpha/2)s^*(t-x')\,e^{-j\omega Lt} \\ &= a_0e^{-j\omega Lt}+(a_0 j\alpha/2)z_s^*(t-x')\,e^{-j(\omega L+\omega c)t}\,e^{+j\omega cx'}\end{aligned}$$

The first term is the dc wave and the second is the +1 diffracted wave. The imaging system $L_1$ and $L_2$ inverts (15) spatially in x. To simplify notation, define the +x axis for AO2 and $P_2$ as outward and thus (15) also describes the light incident on AO2.

The input reference signal to AO2 is $$r(t) = x_r(-t)\cos\omega_c t + y_r(-t)\sin\omega_c t \quad (16)$$
$$= Re\{z_r(-t)\, e^{+j\omega_c t}\} = Re\{[x_r(-t) - jy_r(-t)]\, e^{+j\omega_c t}\},$$

where the $(-t)$ argument denotes a time-reversed signal in this reference AO2 signal, compared to the AO1 input signal in (14), and where use has been made of cos $(-\theta)=\cos(+\theta)$ and $\sin(-\theta)=-\sin(\theta)$. The +1 diffracted order light from AO1 is incident on AO2 at the Bragg angle and thus sees a transmittance of AO2 given by $$u_2(x,t)=1+(j\alpha/2)\bar{r}(t+x')=1+(j\alpha/2)z_r(-t-x')e^{-j\omega_c(t+x')}. \quad (17)$$

In (17), $(t+x')$ is substituted rather than $(t-x')$ for t since the x axis is reversed at $P_2$ compared to $P_1$. The analytic signal $\bar{r}$ is defined analogous to (8a).

The doubly diffracted first-order wave is the product of the last term in (15) and the last term in (17). It leaves AO2 traveling in +z (parallel to the optical axis). The first-order wave from AO1 undiffracted by AO2 is still traveling down at $-2\theta_B$. The dc wave or zero-order term in (15) is incident parallel to the z (optical) axis and AO2 is tilted at $-\theta_B$. The zero-order input wave in (15), undiffracted by AO2, thus leaves AO2 in the +z direction and is described by the first term in (15). The zero-order input wave diffracted by AO2 leaves AO2 going downward at $-2\theta_B$. The two waves leaving AO2 parallel to +z are thus $$u_2'(x,t)=a_0e^{-j\omega Lt}-(a_0\alpha^2/4)z_s^*(t-x')z_r(-t-x')e^{-j(\omega L+2\omega_c)t}. \quad (18)$$

Term one in (18) is the original zero order wave from AO1 undiffracted by AO2. The doubly-diffracted first-order wave leaving AO2 is the second term, the desired correlation term. These two terms travel colinearly and thus reach the $P_3$ detector. The other term leaving AO2 travel at $-2\theta_B$ angle with respect to the z axis and thus do not land on the $P_3$ detector and hence their effects in the $P_3$ output are not considered. The light amplitude incident on $P_3$ is thus the spatial integral of terms one and three in (18).

The full intensity detected output at $P_3$ is thus $$I_3(t) = |\int a_0e^{-j\omega Lt} - (a_0\alpha^2/4)z_s^*(t-x')z_r(-t-x')e^{-j(\omega L+2\omega_c)t}\,dx|^2 \quad (19)$$
$$= B + 2cRe\{\int z_s(t-x')z_r^*(-t-x')dx'\}e^{+j2\omega_c t}$$
$$= B + 2cRe[e^{+j2\omega_c t}(z_s \odot z_r^*)],$$

where B is a bias term (one component of it is also a function of time), c is a constant and the correlation shift variable will be 2t. Substituting for $z_s$ and $z_r$, one obtains $$I_3(t) = B + 2cRe\{[(x_s - jy_s)\odot(x_r + jy_r)](\cos 2\omega_c t + j\sin 2\omega_c t)\} \quad (20)$$
$$= B + 2c[(x_s \odot x_r) + (y_s \odot y_r)]\cos 2\omega_c t + 2c[(y_s \odot x_r) - (x_s \odot y_r)]\sin 2\omega_c t.$$

From (20), it is noted that the real and imaginary parts of the complex correlation are available on quadrature (cosine and sine) temporal output carriers. Either or both of these terms is easily extracted from the full correlation output by standard mixing and LFP techniques. Thus, the system of FIG. 1 yields an output with terms agreeing with those in (13). From (19) and (20), it is also noted that the output temporal carrier is at $2\omega_c$ (twice the input carrier to AO1 and AO2). This doubling of the output temporal carrier frequency is due to the cross-propagating signals in the cells.

When several such mini-correlations are available, one can delay and sum them and obtain the equivalent of the correlation of a longer signal with no PG loss (if a complex-valued sum is used). Complex correlations are essential for use of this processor. For example, consider one channel of FIG. 1 with the split $L_3$ and $L_4$ output lens system used. The output from each detector can be written as an integral over the associated aperture, and their sum can be represented as $$\int_0^{v_sT_A/2} s(x)r(x-\tau)dx + \int_{v_sT_A/2}^{v_sT_A} s(x)r(x-\tau)dx, \quad (21)$$

where $v_sT_A=x_A$ is the spatial aperture of the AO cell and $\nu=v_st$. If these two detector outputs are to be summed, as noted in (21) to achieve a spatial integration of the full $X_A$ aperture, then each must be a complex correlation output and one may add their real parts (to obtain the proper full output correlation and the associated PG and noise performance). Use will be made of the temporal carrier frequency for the output correlation signal in the advanced application in Section 7. For now, note that if two received signals on two frequencies are present in AO1 and if two different reference signals on the same two frequencies are present in AO2, then the $P_3$ output will only contain the correlations of the pairs of the signals that are on the same frequencies (since the cross-frequency signal pairs will not land on an output detector at $P_3$). Even though these two correlations are present on the same output detector, one can separate them since they are present on two different temporal carriers. This is a new aspect of this SI processor and is achieved by proper Bragg angle orientation of the AO cells.

The treatment of signals as I and Q channel data x(t) and y(t) is quite general and compatible with general RF preprocessing electronics. For the case of minimum shift keying (MSK) data modulation, a conventional technique with considerable bandwidth advantages, this data modulation is achieved by encoding the even e(t) and odd o(t) bit sequences in the code on quadrature carriers as $$s(t)=e(t)\cos(\omega_B/4)t+o(t)\sin(\omega_B/4)t, \quad (22)$$

where $\omega_B$ corresponds to the bit or chip rate and the AO cell carrier $\omega_c$ is chosen to be an integer multiple of $\omega_B/4$, i.e. $\omega_c=N\omega_B/4$. As seen from (22), this modulation technique is quite analogous to the I and Q data description that was used.

The final attractive feature of this processor noted is its ability to perform either coherent or noncoherent demodulation. If the absolute phase of the received signal is known (from phase-locked-loop or other standard phase estimation techniques), then the complex correlation output or its real part can be obtained as detailed above. If the absolute phase of the received signal is in error by $\psi_e$, the output in (20) has quadrature factors $\cos(2\omega_c t-\psi_e)$ and $\sin(2\omega_c t-\psi_e)$. If $\psi_e=0$, the proper correlation term cannot be extracted as in (20) by mixing and an LPF. In such cses, nocoherent demodulation is essential. This can be achieved on the processor by mixing and LPF with cos ($2\omega t$) and sin ($2\omega t$), squaring each LPF output and using their sum as the final output correlation. The system allows the unique ability (for an optical system) to separately form the real and imaginary parts of the complex correlation and to then perform either a coherent or noncoherent detection (as needed).

4. Standard Waveform Synchronization

Figure 2:
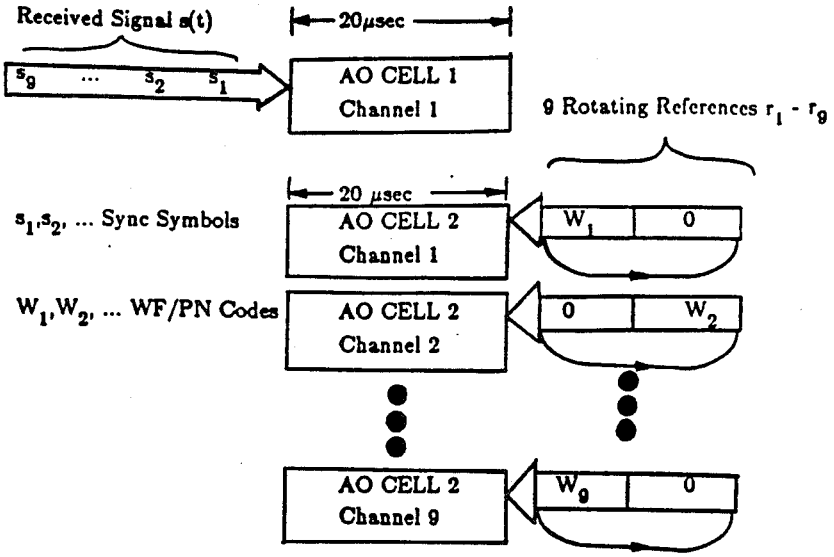
FIG. 2 illustrates the reference and received signal patterns for general signal synchronization using the system of FIG. 1.

A standard synchronization waveform consists of several (M) symbols (each of duration $T_S$) with an underlying pseudo-noise (PN) or similar waveform and with some encoding such as Walsh functions (WFs) on each symbol and with a bandwidth conserving modulation such as MSK also present. Consider such a general synchronization waveform with M symbols as described above. There is no loss in generality of the processor if the synchronization waveform differs from this typical format. One can view the entire synchronization section as one long signal of duration $MT_S$. The synchronization of such a signal requires that one correlates a signal of duration $MT_S$ and bandwidth $BW_S$ with an infinite range delay search ($T_D=\infty$). This is achieved using N channels of the system of FIG. 1 with recycled references fed to each AO2 channel. The number of channels N required is determined by the full $T_S'=MT_S$ signal duration and the AO cell length $T_A$ as $NT_A/2 \geqq T_S'$. In all synchronization applications, the $A_n$ and $B_n$ detector outputs on each channel n are coherently summed. Each channel of the processor in FIG. 1 handles a signal duration $T_A/2$ (with an infinite range delay search) and N of these channels (when properly used) satisfies the processing requirement. The symbol present in the n-th section of the synchronization section of the signal is denoted by $W_n$. FIG. 2 shows the received signal fed to AO1 (with separate symbol sections of it denoted by $s_n$ and the reference signal pattern fed to each AO2 channel denoted by $r_n$). Each AO channel length $T_A$ is shown as 20 μsec in FIG. 2 (although general $T_A$ values can be used). Nine channels of AO2 are shown in FIG. 2, although this can easily be generalized to N channels. As shown in FIG. 2, each $r_n$ channel signal consists of a given $W_n$ code of length $T_S$ (followed by zero for a duration $T_S$). Each of these $2T_S$ duration electronic reference patterns are cyclically repeated (the arrow below each reference pattern denotes a cyclic signal). Assume that $T_S$ satisfies (1). By tracing the signals in FIG. 2, one finds that each AO2 channel searches for the presence of one symbol (with $T_D=\infty$). With M symbols, the N=M channels of the full system handle the complete synchronization signal. The reference signal arrangement in FIG. 2 is referred to as a time- and space-multiplexed reference signal (with recycled references as noted earlier and as used in all cases).

In the synchronization section, the set of M symbols $W_n$ are known, and thus the M=N reference signals for the M=N channels of AO2 are known. The order of these M symbols $W_n$ is also known, as is the way to delay and sum the N detector outputs. The correlation output on the n-th detector (for the n-th reference symbol) in the synchronization sequence is delayed by $(n-1)T_S$ and the sum of the N correlation outputs (delayed as noted above) is continuously formed on a single output line. The occurrence of a peak on this single output sum signal line denotes synchronization. The threshold used can be set at the level desired for a given probability of detection, false alarm or error. If the bandwidth and TBWP specifications of the AO cells allow it, frequency-multiplexing techniques (see Section 7) can be included if required. As in all uses of this system, varying the electronic reference signal to the processor can allow different synchronization signals to be processed on the same basic architecture.

5. General Signal Demodulation Processing

A general signal contains a message section, with one of M message symbols transmitted at successive times $T_S$. The n-th message code is denoted by $m_n$ (these message codes generally have an uderlying PN code, with encoding such as WFs and bandwidth conserving modulation such as MSK. The specific encoding and modulation techniques do not significantly affect the processor. For demodulation with the reference and received signals aligned, the orthogonal properties of WFs are attractive since peak aligned cross-correlations are zero. Multiplication by the underlying PN code does not destroy this property. In synchronization, shifted cross-correlations must be considered and herein WF encoding offers no advantage. The general requirements for demodulation of such signals require one to correlate each received $m_n$ message symbol versus the M possible reference message codes (which we denote by $W_n$) with $T_D=O$ (since the system is in synchronization). In all modulation applications, each $A_n$ and $B_n$ detector output is separately used; i.e. the detector outputs on each channel are not summed, as was done in synchronization processing. This is possible because $T_S$ must satisfy (1) and because $T_D=O$ in demodulation.

Figure 3:
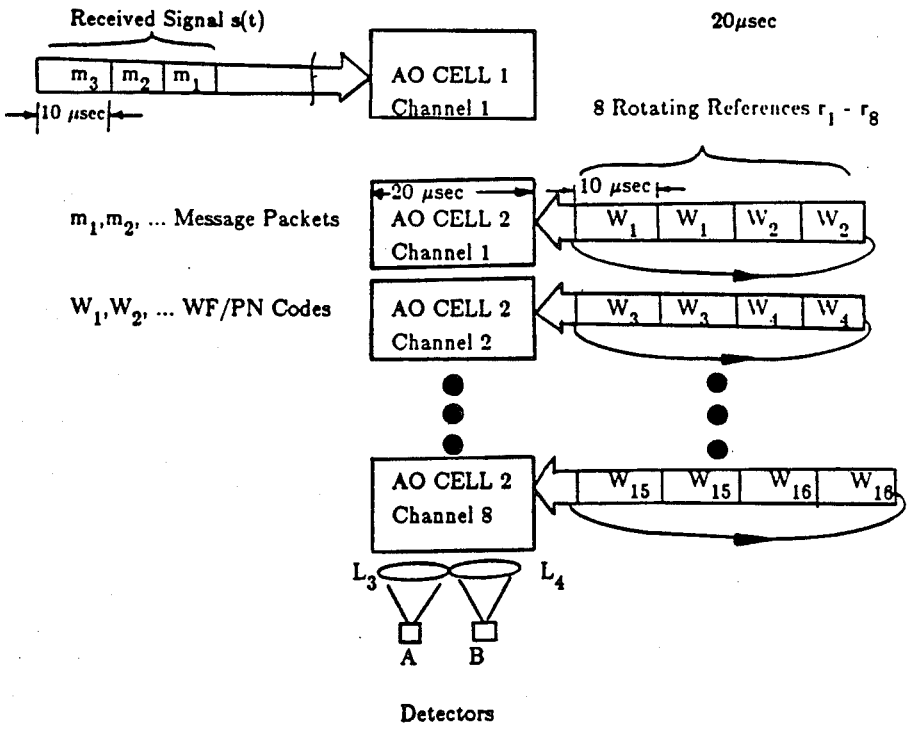
FIG. 3 illustrates the reference and received signal patterns for general signal demodulation using the system of FIG. 1.

FIG. 3 shows the received signal with message symbols $m_n$ ($T_S=10$ μsec duration is assumed and $T_A=20$ μsec) fed to AO1 of FIG. 1 and with the reference signal patterns $r_n$ fed to the first 8 reference channels of AO2 shown. Each reference signal inputs consists of one possible message symbol $W_n$ repeated twice, followed by another possible message symbol repeated twice, with this full $4T_S$ signal pattern repeated cyclically. FIG. 3 shows the case of N=8 channels at AO2 and 16 possible reference message symbols $W_1$ to $W_{16}$. The system and basic concept extend to more message symbols as desired and as allowed by the AO cells used. For the situation considered, consider only the AO channel one and extrapolate the results from this one channel case. Consider the timing when $m_1$ is present in the left-half of AO1 and $W_1$ is present in both halves of AO2. This is easily arranged since the received signal s(t) is in synchronization. Detector $A_1$ forms the correlation $m_1 \circledast W_1$. Then $T_S$ later, detectors $A_1$ and $A_2$ contain the correlations $m_2 \circledast W_1$ and $m_1 \circledast W_2$ respectively. A time $2T_S$ later, the outputs are $m_3 \circledast W_2$ and $m_2 \circledast W_2$. This procedure continues and finally one obtains the correlation of each $m_n$ with $W_1$ and $W_2$ (from channel n=1). In parallel, the other AO2 channels provide the correlations of the same $m_n$ with two other $W_n$ references per channel of the system. If the $A_n$ outputs are delayed by $T_S$, the sum of the $B_n$ and delayed $A_n$ outputs can be sampled in parallel each $T_S$ and from a standard maximum-selection circuit the symbol present each $T_S$ can be determined. If the message symbols possible are changed (such as would occur when processing a different coded signal), the electronic reference signals fed to the processor can be changed accordingly. If the $BW_A$ and $TBWP_A$ for the AO cells allow, one can include frequency-multiplexing to increase the number of possible message symbols that the system can accommodate. This mode of operation is discussed in Section 7.

6. Frequency Hopping Preprocessing

Before detailing the use of the frequency selection that the system allows and discussing its use in processing frequency hopped (FH) encoded signals, preprocessing techniques useful to reduce the bandwidth requirements of any FH signal processor are considered. A typical FH coded signal consists of a synchronization and message section with each divided into a number of symbol times $T_S$ as before. In each $T_S$, a different B-bit PN code $s_n$ can be present with a different carrier frequency in each symbol time and generally with modulation such as MSK present. As before, the specific signal modulation does not affect the processor. Let the subscript n is $s_n$ denote the order of the PN codes in the synchronization section (i.e., the synchronization section contains PN codes in the order $s_1$, $s_2$, etc.). The frequency present in a given $T_S$ varies in a known manner (determined by the FH coding). It is customary for the FH frequencies to vary over a large range. In some cases, these frequencies will lie in several bands centered at frequencies $f_a$, $f_b$, etc. with small bandwidths around $f_a$, $f_b$, etc. (compared to the separations $f_a - f_b$, etc.). In such cases the received FH signal can be mixed with $f_a$, $f_b$, the output lowpass filtered and heterodyned to yield a significantly reduced input signal bandwidth requiring further processing. The FH frequencies possible in the synchronization section (at any time) are known to authorized users. For the case of F such frequencies, we can simply heterodyne the received signal to these F frequencies, LPF and arrange the F outputs on F adjacent intermediate frequency (IF) frequencies. With each symbol of bandwidth $BW_1$, the bandwidth of the synchronization section can thus be reduced to $F(BW_1)=BW_S$. Once the system is in synchronization, the FH frequency sequence is known and the time of arrival of each $T_S$ symbol is known. Thus, one can heterodyne each message symbol with the proper FH frequency, thereby removing the FH modulation and thus converting the demodulation requirements to simply determining the B-bit PN code present in each message symbol.

7. FH Signal Processing

To detail the use of FIG. 1 and the synchronization and demodulation of FH coded data, several specific parameters are assumed for specificity in the description. The basic processing concept can be generalized to other cases. Assume F=8 frequency-hopped frequencies are present in the synchronization section (denote these, after the heterodyne preprocessing by $f_1$ to $f_8$, not necessarily in this order). It is assumed that the heterodyned full input signal bandwidth satisfies $8BW_1=BW_S=BW_{A1}$ (the bandwidth of AO1). Assume 16 different PN codes (in the order $s_1$ to $s_{16}$) to be present in the synchronization section. Assume 5-bit PN codes (B=5) and thus a total of 32 possible codes $s_n$. Assume that the received signal has been heterodyned to F=8 frequencies. In each $T_S$, only one of these frequency bands will have signal information, but which one has information is not known. Assume that simple power detection in each frequency band cannot reliably determine the frequency present. If this were possible, the processor could be simplified further. Also assume the frequency varies between adjacent $T_S$ sections. Thus, any given $T_S$ of time will not contain two $s_n$ codes on the same frequency.

Thus, the synchronization processing requirements involve the correlation of the full 16 $T_S$ synchronization section with $T_D=\infty$ with the ordered set of symbols $s_1$ to $s_{16}$ with the proper heterodyned $f_n$ frequency placed on each $s_n$ reference symbol (in the order determined by the FH code). This synchronization is achieved by correlating each $T_S$ portion of the received signal (with $T_D=\infty$) with all 16 possible PN-FH symbols. The 16 correlation outputs are properly delayed (according to the PN and FH code) and coherently summed to give one output. A peak above threshold on this summation output denotes synchronization. A continuous search is again provided with $T_D=\infty$ (with properly arranged reference signals per AO2 channel). As before, if the synchronization code is changed, the electronic input reference and heterodyned frequencies can be changed appropriately.

As in all synchronization cases, the $A_n$ and $B_n$ detector pairs on each channel n are summed and cyclic references used to provide full $T_D=\infty$ search over a signal duration $T_S$. By properly using the frequency-selectivity of the processor of FIG. 1, one can achieve 16 such correlations with full $T_D=\infty$ search using only 8 channels of AO2 and 8 output detectors at $P_3$. Each channel of AO2 is fed with 2 of the 16 PN codes $s_n$ on the proper $f_n$ for the $s_n$. These references are arranged such that the two $s_n$ frequencies present on each AO2 channel are different. Since only one frequency $f_n$ will be present in AO1 (in a given $T_S$), only the output detector channel n for which the $f_n$ frequency to AO2 matches the $f_n$ frequency present at AO1 will have an output. This occurs since the architecture of FIG. 1 insures that only the correlation of signals with the same frequencies in AO1 and AO2 will fall on an output detector. Since there are 8 frequencies in the 16 synchronization symbol sections and two occurrences of each frequency, 2 of the 16 reference signals and two output channels will yield $P_3$ outputs. These will occur on separate detectors (guaranteed by our reference signal arrangement). One of these outputs will be a crosscorrelation and the other will be an autocorrelation. The former is expected to be much less than the latter. At successive $T_S$ times, different detector outputs will have data present (the sequence of detector outputs with the proper data is known from the $f_n$ frequency sequence and the associated $s_n$ sequence in the synchronization section). Thus, by appropriately delaying and summing these complex correlation outputs, the full synchronization section signal correlation is obtained. An additional degree of noise filtering is automatically provided since the detector outputs will be present on the temporal carrier $2f_n$. Thus, with two BPFs (bandpass filters) per output channel (centered at the proper frequencies), extraneous noise outside of this narrowband will not be present in the output data to be further processed.

Next, consider the demodulation requirements for this signal. With FH coding removed in the message section by the preprocessing in Section 6, this problem is thus a conventional correlation of each reference symbol in the message section with the 32 message codes $s_n$ possible in each $T_S$ (with $T_D$=O since the system is in synchronization). This demodulation problem can thus be generalized to a discussion of the use of time, space and frequency-multiplexing techniques (with no specific attention to FH modulation applications). These basic time, space, and frequency-multiplexing concepts have been advanced elsewhere (D. Casasent, "Frequency-Multiplexed Acousto-Optic Architectures and Applications", supra; and D. Casasent, "General Time, Space and Frequency-Multiplexed Acoustic Correlator", supra. However, their specific use differs with each signal application and with each processing architecture. The $BW_A$ and $TBWP_A$ of the AO cells and the number of channels N present in AO2 determine the demodulation capacity possible in the processor. One arrangement to demonstrate the general concept uses only the $A_n$ detectors and only 8 detector outputs to process 32 simultaneous correlations using only these 8 detector outputs. The basic concept can be generalized further using the basic techniques discussed. The received signal PN message code $m_n$ is heterodyned to 4 frequencies $f_1$ to $f_4$ (spaced by $BW_1$) and these 4 signals are fed simultaneously (frequency-multiplexed) to AO1. Each channel of AO2 is fed with 4 different reference PN codes (e.g., $r_1$ to $r_4$ for channel 1). With 8 channels, one can thus accommodate the 32 possible message symbols in our example. In each channel of AO2, the 4 reference codes are placed in parallel (frequency-multiplexed) on 4 different frequencies ($f_1$ to $f_4$, the same 4 frequencies used in AO1) with 1 reference code per frequency. Thus, for channel $n=1$, the input message $m_n$ is correlated in parallel with $r_1$ to $r_4$ and all 4 correlation outputs occur superimposed on the same detector $A_1$. Behind detector $A_1$, are placed four BPFs (centered at $2f_1$ to $2f_4$). For all $N=8$ channels, there are thus 32 BPF outputs and these can be sampled in parallel each $T_S$ (the sample times are known, since the system is in synchronization). The output with a maximum denotes the message present in the given symbol time $T_S$. If no output is obtained, the sample times can be skewed to allow a search in the event that the system has drifted out of synchronization.

8. Preferred AO and Optical Arrangement

Figure 4:
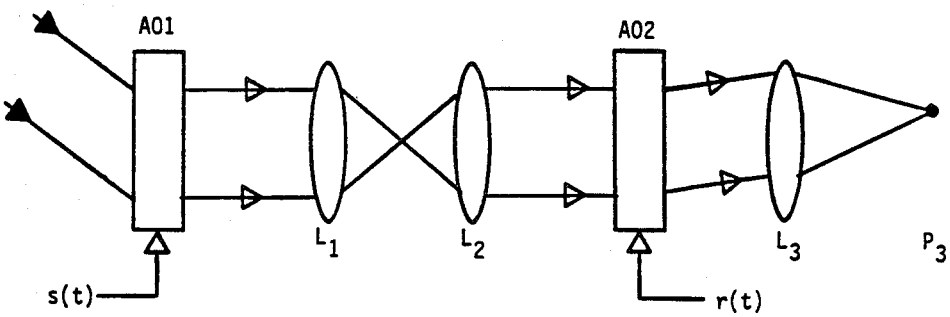
FIG. 4 is a schematic diagram illustrating the preferred AO cells and optical wave orientations for the system of FIG. 1.

The AO and input optical wave arrangement of FIG. 4 (shown in 1-D for simplicity) is preferably since both AO cells are prallel and hence imaging by $L_1$ and $L_2$ is easier. Both cells are vertical and the input light is incident at $-\theta_B$. The zero and $+1$ order waves leave AO1 at $-\theta_B$ and $+\theta_B$ respectively and enter AO2 at $+\theta_B$ and $-\theta_B$ respectively. The output detected at $P_3$ is the zero-order wave from AO1 undiffracted by AO2 and the $+1$ order wave from AO1 double diffracted by AO2. These two waves are incident colinearly on the same $P_3$ detector location. The final $P_3$ output is the same as for one channel of FIG. 1.

I claim:

1. A method of correlating a long duration and large time bandwidth product signal with a plurality of reference signals, each having a symbol duration $T_s$, comprising the steps of:

(a) providing an acousto-optic multi-channel integrating correlator having a first acousto-optic cell having an input transducer for creating a sound field in said cell, said sound field responsive to a signal applied thereto;

light source means for directing light toward said first acousto-optic cell at the Bragg angle;

a second acousto-optic cell, said second acousto-optic cell having a plurality of acousto-optic channels, each channel having an acousto-optic cell element having an input transducer for creating a sound field in said acousto-optic cell element responsive to a signal applied thereto;

first lens means for directing DC and a first order light wave from said first acousto-optic cell to uniformly illuminate each cell element of said second acousto-optic cell with said DC and first order light wave components, with each component being incident upon each acousto-optic cell element at the Bragg angle;

at least one light detector for each respective acousto-optic cell element or providing a signal responsive to the light incident thereto; and second lens means for directing, from said second acousto-optic cell, the undiffracted by said second acousto-optic cell DC component from said first acousto-optic cell and a doubly diffracted first order diffraction component of said first order light wave to the respective said at least one detector (b) repetitively producing a respective reference signal to each respective acousto-optic cell element of said second acousto-optic cell (c) providing the signal to be processed to the first acousto-optic cell wherein the signal to be processed and each reference signal are complex signals, and wherein each complex correlation of the signal to be processed and a respective reference signal is mixed with inphase and quadrature carriers of the same frequency as the complex correlation and phase referenced to the sigal to be processed, and the result of each mixing is low pass filtered to provide the real and imaginary parts of the complex correlation, respectively (d) delaying the output of each respective at least one light detector for the respective acousto-optic cell element by increasing amounts (e) coherently summing the outputs of each of the light detectors to provide a continuous correlation output for the system.

2. The method of claim 1 further comprised of the steps of band pass filtering each correlation of the two complex signals.

3. The method of claim 1 wherein the signal to be processed and each reference signal are complex signals, and wherein each complex correlation of the signal to be processed and a respective reference signal is mixed with inphase and quadrature carriers of the same frequency as the complex correlation, the result of each mixing being low pass filtered and then squared and added together to provide the incoherent correlation between the two complex signals.

4. The method of claim 3 further comprised of the steps of band pass filtering each correlation of the two complex signals.

5. In an acousto-optic multi-channel space integrating correlator of the type having an acousto-optic cell having a plurality (n) of acousto-optic cell elements, each element with a transducer at one end thereof wherein the output of a light detector receiving light from each cell represents the correlation of the signal applied to the respective cell element and another signal, the improvement comprising a segmented lens means having a plurality of lens segments (m);

a plurality ($n \times m$) light detectors equal in number to the product of the number of acousto-optic cell elements (n) and the number of lens segments (m), each lens segment being disposed to direct light from a respective fraction of each cell element to a respective light detector; and means for repetitively providing m successive and different reference signals to each respective cell element, whereby n×m reference signals be searched in an n chanel acousto-optic multi-channel space integrating correlator.

6. An acousto-optic multi-channel space integrating correlator comprising a first acousto-optic cell having an input transducer for creating a sound field in said cell, said sound field responsive to a signal applied thereto;

light source means for directing light toward said first acousto-optic cell at the Bragg angle;

a second acousto-optic cell, said second acousto-optic cell having a plurality (n) of acousto-optic cell elements, each cell element having an input transducer for creating a sound field in said acousto-optic cell element, said sound field responsive to a signal applied thereto;

first lens means for directing a DC term and a first order light wave from said first acousto-optic cell to uniformly illuminate each cell element of said second acousto-optic cell with said DC term and with first order light wave components, with each said component being incident upon each acousto-optic cell element at the Bragg angle;

a plurality (m) light detectors for each respective acousto-optic cell element for providing a signal responsive to the light incident thereto;

a segmented second lens means having a plurality of lens segments (m), each for directing, from said second acousto-optic cell, the undiffracted by said second acousto-optic cell DC component from said first acousto-optic cell and a doubly diffracted first order diffraction component of said first order light wave to a respective detector, means for repetitively providing m successive and different reference signals to each respective cell element, whereby n×m reference signals be searched an n channel acousto-optic multi-channel space integrating correlator.

7. The acousto-optic multi-channel space integrating correlator of claim 6 further including means for placing the m reference signals on one carrier frequency and employing f frequency inputs to said second acousto-optic cell and f bandpass filters on each output detector, thereby increasing the number of reference signals that can be handled by a factor of f.

8. A method of preprocessing a frequency hopped encoded signal having frequency components centered about widely spread frequencies to reduce the bandwidth requirement of a frequency hopped signal processor comprising the steps of (a) mixing the frequency hopped signal with each of a plurality of carriers, each of a predetermined carrier frequency;

(b) low pass filtering the result of step (a), whereby only the lower sidebands of the mixing are preserved, said predetermined carrier frequency of each of said carriers each being selected to result in the shifting of the widely spread frequencies of said frequency hopped encoded signal to a much narrower predetermined frequency band.

* * * * *

UNITED STATES PATENT AND TRADEMARK OFFICE

CERTIFICATE OF CORRECTION

PATENT NO. : 4,833,637

DATED : 5/23/89

INVENTOR(S) : Casasent et al.

It is certified that error in the above-identified patent and that said Letters Patent is hereby corrected as shown below:

| | | |
|---|---|---|
| col. 14, line 29 | delete "sigal" | insert --signal-- |
| col. 15, line 06 | delete "chanel" | insert --channel-- |

Signed and Sealed this

Fifth Day of March, 1991

*Attest:*

HARRY F. MANBECK, JR.

*Attesting Officer*

*Commissioner of Patents and Trademarks*